US011587749B2

(12) United States Patent
Lang et al.

(10) Patent No.: US 11,587,749 B2
(45) Date of Patent: Feb. 21, 2023

(54) CONTACT UNIT FOR A SWITCHING DEVICE AND SWITCHING DEVICE

(71) Applicant: Eaton Intelligent Power Limited, Dublin (IE)

(72) Inventors: Volker Lang, Bonn (DE); Albert Zacharias, Neuwied (DE); Christian Ruempler, Bonn (DE); Kai Schroeder, Niederkassel (DE); Ute Molitor, Bonn (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/414,334

(22) PCT Filed: Dec. 16, 2019

(86) PCT No.: PCT/EP2019/085249

§ 371 (c)(1),
(2) Date: Jun. 16, 2021

(87) PCT Pub. No.: WO2020/126978

PCT Pub. Date: Jun. 25, 2020

(65) Prior Publication Data

US 2022/0044891 A1 Feb. 10, 2022

(30) Foreign Application Priority Data

Dec. 18, 2018 (GB) ..... 1820594

(51) Int. Cl.
*H01H 33/18* (2006.01)
*H01H 33/53* (2006.01)

(52) U.S. Cl.
CPC ..... *H01H 33/182* (2013.01); *H01H 33/53* (2013.01)

(58) Field of Classification Search
CPC .... H01H 33/182; H01H 33/187; H01H 33/04; H01H 33/53; H01H 33/38; H01H 9/36;
(Continued)

(56) References Cited

U.S. PATENT DOCUMENTS 5,138,122 A * 8/1992 Moldovan ..... H01H 51/12 218/22
8,040,210 B2 * 10/2011 Kim ..... H01H 33/666 335/266

(Continued)

FOREIGN PATENT DOCUMENTS

EP 2590192 A1 5/2013
GB 548472 A 10/1942

*Primary Examiner* — William A Bolton
(74) *Attorney, Agent, or Firm* — Leydig, Voit & Mayer, Ltd.

(57) ABSTRACT

A contact unit for a switching device includes: a first fixed contact; a second fixed contact; a contact bridge; a first movable contact and a second movable contact that are arranged at the contact bridge; a first arc extinguishing chamber, a second arc extinguishing chamber, and a third arc extinguishing chamber; and an arc guiding system. The first fixed contact is in contact with the first movable contact and the second fixed contact is in contact with the second movable contact in a switched-on state of the contact unit. The first fixed contact is free of contact with the first movable contact and the second fixed contact is free of contact with the second movable contact in a switched-off state of the contact unit. The first and the second arc extinguishing chamber and the arc guiding system in coordination with each other extinguish a first arc.

20 Claims, 4 Drawing Sheets

(58) Field of Classification Search
CPC ..... H01H 9/46; H01H 9/443; H01H 1/20; H01H 1/2025; H01H 50/546
USPC ..... 218/148, 23, 26, 34, 36, 38, 40, 47, 81, 218/103–105
See application file for complete search history.

(56) References Cited

U.S. PATENT DOCUMENTS

| | | | | |
|---|---|---|---|---|
| 8,097,824 | B2 * | 1/2012 | Kil | H01H 9/36 218/156 |
| 8,921,728 | B2 | 12/2014 | Lang et al. | |
| 9,076,606 | B2 * | 7/2015 | Schneider | H01H 9/443 |
| 9,214,305 | B2 * | 12/2015 | Lang | H01H 9/346 |
| 9,653,237 | B1 | 5/2017 | Zhou et al. | |
| 2007/0268097 | A1 * | 11/2007 | Elviro | H01H 71/0207 335/6 |
| 2013/0264310 | A1 | 10/2013 | Lang et al. | |
| 2013/0264311 | A1 | 10/2013 | Lang et al. | |
| 2013/0313228 | A1 | 11/2013 | Lang et al. | |
| 2014/0151338 | A1 | 6/2014 | Gerving et al. | |
| 2014/0347151 | A1 * | 11/2014 | Gerving | H01H 9/36 335/205 |

* cited by examiner

CONTACT UNIT FOR A SWITCHING DEVICE AND SWITCHING DEVICE

CROSS-REFERENCE TO PRIOR APPLICATIONS

This application is a U.S. National Phase application under 35 U.S.C. § 371 of International Application No. PCT/EP2019/085249, filed on Dec. 16, 2019, and claims benefit to British Patent Application No. GB 1820594.8, filed on Dec. 18, 2018. The International Application was published in English on Jun. 25, 2020 as WO 2020/126978 under PCT Article 21(2).

FIELD

The present disclosure is related to a contact unit for a switching device and a switching device.

BACKGROUND

A switching device usually comprises a switching portion and an actuating portion that is often called an electromagnetic actuator to set a switching state of the switching portion.

In general it is a challenge to provide a rapid switch off and a secure and reliable extinguishing of an arc originated between electrical contacts of the switching device.

Document EP 2590192 A1 describes a switch for multipole direct-current operation.

The disclosure is related to a contact unit for a switching device for switching DC currents. The contact unit and the corresponding switching device may be used in the field of electro-mobility.

SUMMARY

In an embodiment, the present invention provides a contact unit for a switching device, comprising: a first fixed contact; a second fixed contact; a contact bridge; a first movable contact and a second movable contact that are arranged at the contact bridge; a first arc extinguishing chamber, a second arc extinguishing chamber, and a third arc extinguishing chamber; and an arc guiding system, wherein the first fixed contact is in contact with the first movable contact and the second fixed contact is in contact with the second movable contact in a switched-on state of the contact unit, wherein the first fixed contact is free of contact with the first movable contact and the second fixed contact is free of contact with the second movable contact in a switched-off state of the contact unit, wherein the first and the second arc extinguishing chamber and the arc guiding system are configured in coordination with each other to extinguish a first arc originating between the first fixed contact and the first movable contact depending on a current direction of a current flowing through the first fixed contact and the first movable contact, and wherein the third arc extinguishing chamber is configured for extinguishing a second arc originating between the second fixed contact and the second movable contact independent of a current direction of a current flowing through the second fixed contact and the second movable contact.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
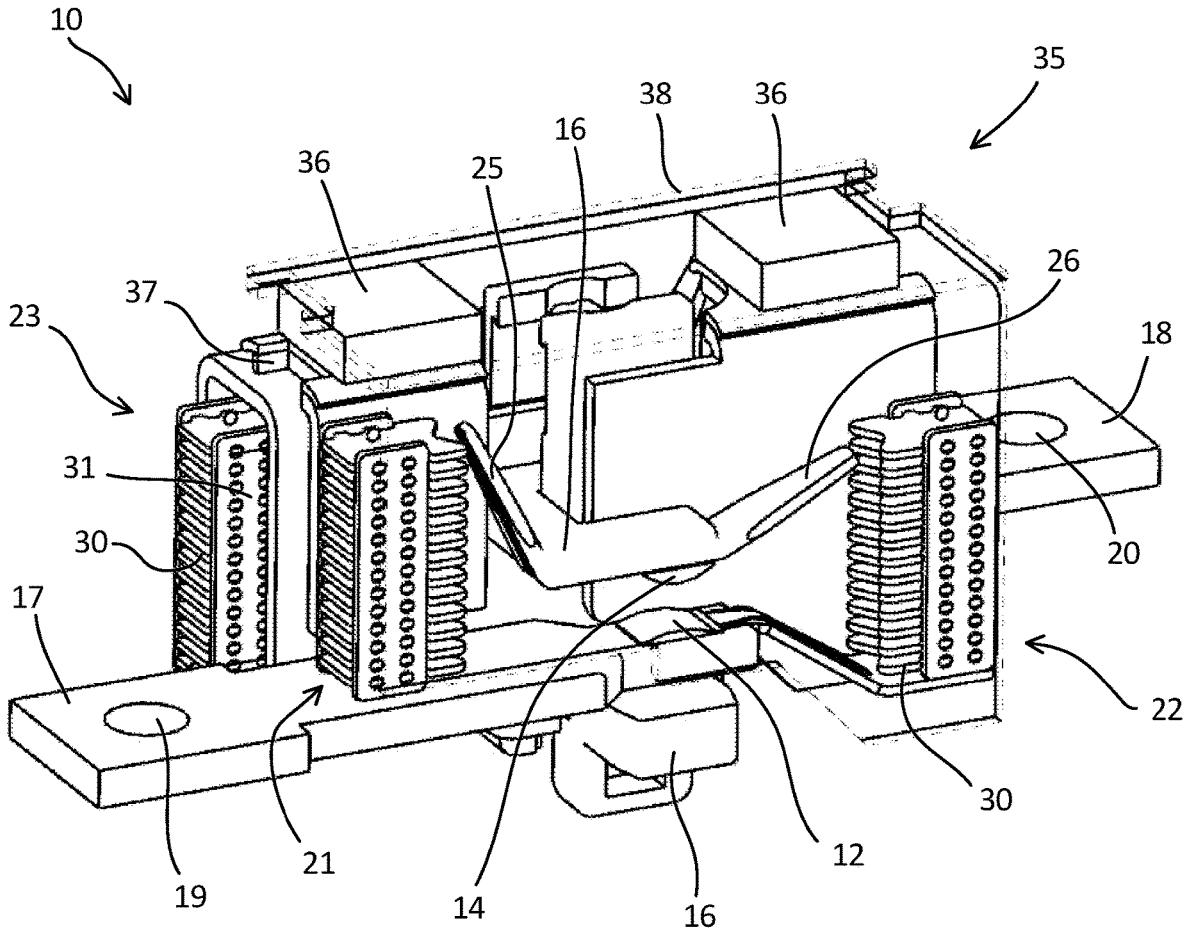
FIG. 1 shows an example of a contact unit for a switching device in a perspective view.

In an embodiment, the present invention provides a switching device and a switching device that enables secure and reliable extinguishing of an arc originated between electrical contacts and that contributes to a low cost manufacturing.

In an embodiment, a contact unit for a switching device comprises a first and a second fixed contact, a contact bridge and a first and a second movable contact that are arranged at the contact bridge, connecting the first and second movable contacts in series. The contact unit further comprises a first, a second and a third arc extinguishing chamber and an arc guiding system. The first fixed contact is in contact to the first movable contact and the second fixed contact is in contact to the second movable contact in a switched-on state of the contact unit, and the first and second fixed contacts are free of contact from the first and second movable contact in a switched-off state of the contact unit, respectively. The first and the second arc extinguishing chamber and the arc guiding system are configured in coordination with each other for extinguishing a first arc originating between the first fixed contact and the first movable contact depending on a current direction of a load current flowing through the first fixed contact and the first movable contact whereas the third arc extinguishing chamber is configured for extinguishing a second arc originating between the second fixed contact and the second movable contact independent of a current direction of an overcurrent flowing through the second fixed contact and the second movable contact.

By use of the described contact unit a switching device is feasible at low cost which enables secure and reliable extinguishing of an arc originated between the first and/or second fixed and movable contacts. In particular, the contact unit enables a construction of a DC protective switching device comprising extinguishing chambers functionally separated from each other.

Such a protective switching device comprises only three arc extinguishing chambers each having a respective function and thus enables to save expenses with respect to further extinguishing chambers. Moreover, by the use of only three arc extinguishing chambers the structure of the contact unit and the corresponding switching device can be simplified and the arc guiding system which is preferably realized as a permanent magnet system can comprise a simplified designed further contributing to a low cost design.

Permanent magnetic fields are used to drive an arc generated in a switching device to an arc extinguishing chamber. Such permanent magnetic fields superimpose the self-generated magnetic field of the current. Depending on a direction of the current flow, the superimposition of the aforementioned magnetic fields can result in reinforcement or weakening of the permanent magnetic field. In the latter case it is possible that the arc is moving in both arcing chambers, depending on the strength of the self-generated field caused by the current flow. For example, in case of an overcurrent, at the beginning the self-generated magnetic field at the position of the arc may be higher than the field by the permanent magnets. Thus, the arc will run into a first extinguishing chamber. Here, the current will decrease. Thus, the strength of the self-generated magnetic field will decrease and at some point become lower than the permanent magnetic field. Therefore, the arc may run back out of the first extinguishing chamber towards the contact area. If the magnetic fields are similar in strength but opposite in direction at the location of the arc, they may cancel each other out, and there is no (or only a low) resulting driving force acting on the arc which may result in that the arc basically remains in its position, for example between the electrical contacts, and thereby the current flow is not interrupted and may cause harm or damage.

By use of the described arrangement of the contact unit it is possible to avoid such a scenario. The first and the second arc extinguishing chambers are configured in coordination with the arc guiding system with respect to switching of operational currents of several 100 A, 500 A, or up to 1000 A, for example. Switching of the operational currents may lead to a first arc generated between the first fixed contact and the first movable contact at a transition between the switched-on state and the switched-off state of the contact unit or the switching device. The permanent magnetic field of the arc guiding system is designed such that it is stronger than the self-generated field by operational currents of this rating. Depending on a direction of the current flowing through the first fixed contact and the first movable contact the first arc is moved to the first or the second arc extinguishing chamber.

The third arc extinguishing chamber is configured independently of the arc guiding system with the purpose to switching overcurrents, for example short circuit currents. When the contact unit switches off an overcurrent, a second arc may be generated between the second fixed contact and the second movable contact at a transition between the switched-on state and the switched-off state of the switching device. In contrast to the first arc described above, the second arc is always moved to the third arc extinguishing chamber independent of a direction of the overcurrent flowing through the second fixed contact and the second movable contact. This may be achieved by not supplying a permanent magnetic field to guide the arc in the area of the second movable and fixed contacts. For overcurrents, the self-generated magnetic field is strong enough to drive the arc into the third arc extinguishing chamber in a reliable manner. In this scenario there is no force that would drive the arc back away from the extinguishing chamber.

Thus, independent of a direction of a current flowing through the fixed and movable contacts of the contact unit, an originated arc is securely and reliably guided to a respective arc extinguishing chamber and damages due to remaining arcs are avoided. Therefore, the described contact unit further contributes to reduced abrasion and to an enhanced lifetime of a switching device.

The current flowing through the fixed and moveable contacts and through the contact bridge may be negative or positive. The current may be a DC current, in particular. The current that flows through the contact bridge between the first and the second movable contact in the switched-on state extends or approximately extends in a first plane. A direction of a movement of the contact bridge between the switched-on state and the switched-off state is perpendicular to the first plane.

According to a preferred embodiment of the contact unit, the arc guiding system comprises a permanent magnet system which is configured to enclose only the first and the second arc extinguishing chamber. In a further embodiment, the first fixed contact and the first movable contact are within an area covered by the magnetic field of the permanent magnet system in the switched-on state and in the switched-off state of the contact unit whereas the second fixed contact and the second movable contact are out of the area covered by the magnetic field of the permanent magnet system in the switched-on state and in the switched-off state of the contact unit. "Out of the area of the magnetic field" means that the magnetic field strength at the second fixed and movable contacts is so low that it does not influence the direction of the movement of an arc generated at that position.

The third arc extinguishing chamber is associated to switch off overcurrents, for example short circuit currents, and is configured to extinguish corresponding arcs without influence of a permanent magnet system.

The first and the second arc extinguishing chambers are at least partially enclosed or surrounded by the permanent magnet system such that a corresponding arc of a load current is guided to move into the first or the second arc extinguishing chamber depending on the load current direction. Thus, secure switching off of all DC currents is enabled using the configuration of the described contact unit.

In an embodiment, the permanent magnet system comprises an inner and an outer pole plate each enclosing the first and the second arc extinguishing chamber, and a permanent magnet that is arranged between the inner pole plate and the outer pole plate to provide an arc guiding magnetic field. Thus, the first fixed contact and the first movable contact may be arranged between the inner and the outer pole plate in the switched-on state and in the switched-off state whereas the second fixed contact and the second movable contact may be arranged outside with respect to the inner and the outer pole plate in the switched-on state as well as in the switched-off state of the contact unit.

The permanent magnet system of the contact unit is preferably configured to blow out arcs that are generated at the switching of DC load currents for example up to 1000 A. The permanent magnet system may be realized as a magnetic field arrangement or permanent magnetic field arrangement. In such an arrangement, the magnetic field, that can also be named magnetic blow out field, acts on the arc that is generated between the first fixed contact and the first movable contact. The magnetic field results in a bulging of the column of the arc and in a movement away from the aforementioned switching contacts.

Since a length of the arc is increased in direction to the respective arc extinguishing chamber, the arc voltage is increased. A further increase is caused by the plates of the arc extinguishing chamber which split the arc into a number of arcs. The arc is extinguished when the arc voltage (that is, the voltage required to sustain the arc) becomes larger than the driving voltage.

In an embodiment of the contact unit the inner pole plate is at least partially L-shaped and the outer pole plate is at least partially L-shaped enclosing the first and the second arc extinguishing chambers. There may be two inner pole plates that are separated. The outer pole plate may have openings. A cross-section of the inner and the outer pole plate that is perpendicular to the inner and the outer pole plate may show two L-shapes at some parts of the pole plates but not necessarily at every part of the pole plates.

According to a further preferred embodiment, the contact unit comprises a magnetic reinforcing element assigned to the third arc extinguishing chamber which is configured to enhance a magnetic field self-generated by a current, for example an overcurrent, between the second fixed contact and the second movable contact. The magnetic reinforcing element is preferably realized as a U-shaped slot motor comprising magnetically conductive material enclosing at least the second fixed and movable contacts. The U-shaped slot motor may extend to and further enclose the third arc extinguishing chamber. The U-shaped slot motor reinforces the magnetic field generated by the current loop formed by the second terminal contact and the second fixed and moveable contacts. Independent of the current direction, the force of this magnetic field acts on the current in the same direction, guiding an arc into the third arc extinguishing chamber.

In an embodiment, the contact unit further comprises a pair of arc runners which are arranged at the contact bridge near the first movable contact and a further arc runner which is arranged at the contact bridge near the second movable contact. Due to the configuration of the third arc extinguishing chamber associated to overcurrent events, there is no need for a fourth arc runner since the second arc originated between the second fixed and movable contacts always runs into the third arc extinguishing chamber.

In a further embodiment, the contact unit comprises a first terminal contact on which the first fixed contact is mounted and a second terminal contact on which the second fixed contact is mounted. Preferably, the fixed contacts are soldered or welded to the respective terminal contact. A main direction of the first terminal contact is parallel to a main direction of the second terminal contact and a straight (virtual) line drawn between the first movable contact and the second movable contact is across the main direction of the first terminal contact. The straight line may be perpendicular to the main direction of the first terminal contact, for example. Thus, the contact bridge is across or perpendicular to the first terminal contact and to the second terminal contact.

The contact bridge may comprise a first outer part on which the first movable contact is fixed and a second outer part on which the second movable contact is fixed. The first terminal contact, the first arc generated between the first fixed contact and the first movable contact at a transition between the switched-on state and the switched-off state and the first outer part of the contact bridge may form a first magnetic field loop that blows the first arc in the direction of the first or second arc extinguishing chamber in interaction with the arc guiding system preferably comprising a permanent magnet system The second terminal contact, the second arc generated between the second fixed contact and the second movable contact at a transition between the switched-on state and the switched-off state and the second outer part of the contact bridge may form a second magnetic field loop that blows the second arc in the direction of the third arc extinguishing chamber independent of a current flow direction and the arc guiding permanent magnet system of the first and the second arc extinguishing chambers.

In an embodiment, a switching device comprises the contact unit as described above and an electromagnetic drive unit coupled to the contact bridge of the contact unit. The electromagnetic drive unit is configured to set the contact unit and respectively the switching device in a switched-on state or in a switched-off state due to excitation or de-excitation of at least one magnetic coil of the electromagnetic drive unit.

Such a configuration of a switching device using an embodiment of the described contact unit enables secure and reliable arc extinguishing and contributes to prevention of damages and to low cost manufacturing. As a result, applicable features and characteristics described in relation to the contact unit are also disclosed with respect to the switching device, and vice versa.

According to an embodiment, the switching device comprises a control circuit having a signal output coupled to a signal input of the electromagnetic drive unit, wherein the control circuit is configured to set the switching device in a switched-on state or in a switched-off state depending on a control signal provided to the signal input of the electromagnetic drive unit.

The switching device may comprise the electromagnetic drive unit as described above using an armature and one or more magnetic coils or an alternative actuator for moving the contact bridge and switching the switching device.

Figure 2:
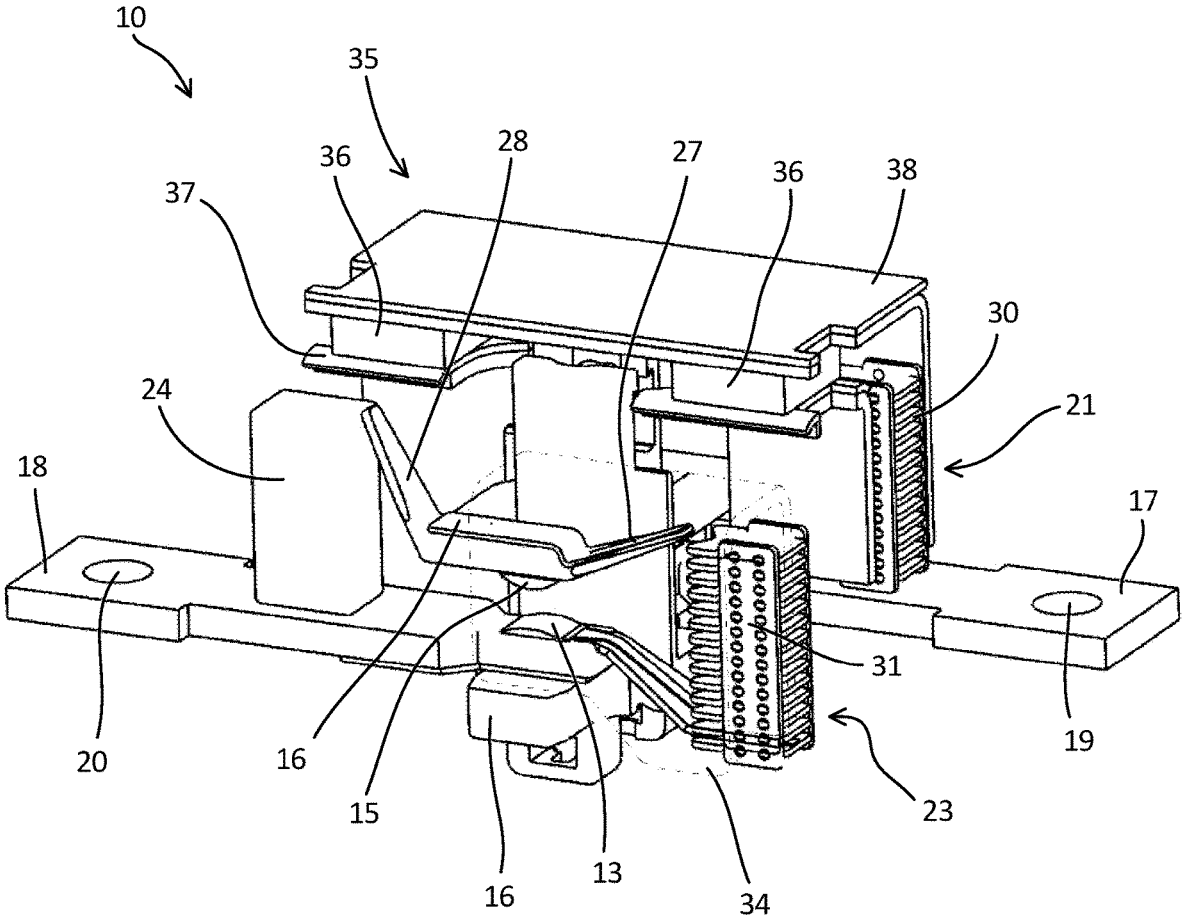
FIG. 2 shows the contact unit of FIG. 1 in a further perspective view.

FIG. 1 shows an example of a contact unit 10 for a switching device in a perspective view. FIG. 2 shows a further perspective view of the contact unit 10 turned to the opposite side. The switching device realizes a circuit switching function and a drive function. In the following the switching function is explained. The contact unit 10 comprises a first and a second fixed contact 12, 13, a first and a second movable contact 14, 15 and a contact bridge 16. The contact bridge 16 may be named switching bridge. The first and the second movable contact 14, 15 are fixed on the contact bridge 16. The second fixed contact 13 and the second movable contact 15 are shown in FIG. 2. With respect to FIG. 1 they are covered behind other parts of the contact unit 10 in the illustrated three-dimensional view. The contact bridge 16 directly connects the first movable contact 14 to the second movable contact 15.

Moreover, the contact unit 10 comprises a first and a second terminal contact 17, 18. The first and the second terminal contact 17, 18 may be named first and second stationary contact piece, fixed contact piece or terminal contact piece and define a respective terminal bus of a main current path. The first fixed contact 12 is directly fixed on the first terminal contact 17. The second fixed contact 13 is directly fixed on the second terminal contact 18. The first and the second terminal contact 17, 18 each have a terminal connection hole 19, 20. An end of the first terminal contact 17 having the terminal connection hole 19 is designed for contacting a first terminal lead that is connected from the outside to the contact unit 10. A terminal lead can be realized as busbar or power cable. An end of the second terminal contact 18 having the terminal connection hole 20 is designed for contacting a second terminal lead that is connected from the outside to the contact unit 10. The terminal connection hole 19 of the first terminal contact may be on an opposite side of the contact unit 10 in comparison to the terminal connection hole 20 of the second terminal contact 18. The two terminal connection holes 19, 20 are configured for fixation of the two terminal leads, e.g., via bolts, pins or studs inserted into the terminal connection holes 19, 20.

The contact unit 10 further comprises a first and a second arc extinguishing chamber 21 and 22. The first and the second arc extinguishing chamber 21 and 22 are attached to the first terminal contact 17. The contact unit comprises only one more arc extinguishing chamber, namely a third arc extinguishing chamber 23 which is fixed on the second terminal contact 18.

Additionally, the contact unit 10 comprises a first pair of arc runners 25, 26 that is fixed at the contact bridge 16 in vicinity of the first movable contact 14. Correspondingly, with respect to the third arc extinguishing chamber 23 the contact unit 10 comprises a further arc runner 27 that is fixed to the contact bridge 16 in vicinity of the second movable contact 15 (see FIG. 2). In FIG. 1 only the arc runner 25 and 26 can be seen. Each of the arc extinguishing chambers 21 to 23 comprises a number of splitter plates 30 that are arranged in a respective holder 31. The holder 31 holds the splitter plates 30 and is connected to the first or the second terminal contact 17, 18.

Additionally, the contact unit 10 comprises a permanent magnet system 35 for guiding an arc originated between the first fixed contact 12 and the first movable contact 14. The permanent magnet system 35 is configured such that it encloses only the first and the second arc extinguishing chamber 21 and 22 but not the third arc extinguishing chamber 23. In other words, the permanent magnetic field of the permanent magnet system 35 solely affects an arc generated at the first fixed and movable contacts 12, 14 and moving to the first or the second arc extinguishing chamber 21 or 22.

Due to such a configuration of contact unit 10 the switching device may be produced at low cost and enables secure and reliable extinguishing of an arc originated between the respective first and/or second fixed and movable contacts 12, 14 and/or 13, 15. In particular, the contact unit 10 enables a construction of a DC protective switching device comprising three extinguishing chambers functionally separated from each other.

The first and the second arc extinguishing chamber 21 and 22 realizes respective extinguishing chambers for switching operational currents up to 1000 A, for example. The first and the second arc extinguishing chamber 21, 22 and the permanent magnet system 35 are configured in coordination with each other for extinguishing a first arc originating between the first fixed contact 12 and the first movable contact 14 depending on a current direction of a current flowing through the first fixed contact 12 and the first movable contact 14.

If the current flow is defined to be a negative current an originated first arc between the first fixed and movable contacts 12 and 14 would be forced to move to the first arc extinguishing chamber 21, for example. Thus, if the current flow is defined to be a positive current an originated first arc between the first fixed and movable contacts 12 and 14 would be forced to move to the second arc extinguishing chamber 22.

The third arc extinguishing chamber 23 is configured for extinguishing a second arc originating between the second fixed contact 13 and the second movable contact 15 independent of a current direction of a current flowing through the second fixed contact 13 and the second movable contact 15. The third arc extinguishing chamber 23 realizes an extinguishing chamber for switching overcurrents, for example short circuit currents, independent of a current flow direction and outside the magnetic influence area of the permanent magnet system 35. Thus, all DC currents can securely and reliable switched off by the described arrangement of the contact unit 10. The second terminal contact 18, the second fixed and moveable contacts 13 and 15 and a portion of the contact bridge 16 close to the second fixed contact 13 realize a current guiding structure which enable forming of a current loop generating a magnetic field which magnetic force acts constantly in the same direction guiding an arc into the third arc extinguishing chamber 23.

A permanent magnetic field can superimpose the self-generated magnetic field of the current. Depending on a direction of the current flow, the superimposition of the magnetic fields can result in reinforcement or weakening. In the latter case it is possible that the arc is moving in both arcing chambers, depending on the strength of the self-generated field caused by the current flow. For example, in case of an overcurrent, at the beginning the self-generated magnetic field at the position of the arc may be higher than the field by the permanent magnets. Thus, the arc will run into a first extinguishing chamber. Here, the current may decrease. Thus, the strength of the self-generated magnetic field will decrease and at some point become lower than the permanent magnetic field. Therefore, the arc may run back out of the first extinguishing chamber towards the contact area. If the magnetic fields are similar in strength but opposite in direction at the location of the arc, they may cancel each other out, and there is no (or only a low) resulting driving force acting on the arc which may result in that the arc basically remains in its position, for example between the electrical contacts. The current flow will not be interrupted and thus may cause harm or damage to components. By use of the described arrangement of the contact unit 10 it is possible to avoid such adverse scenarios.

In the embodiments shown, the permanent magnet system 35 surrounds only the first and the second arc extinguishing chamber 21 and 22. The permanent magnet system 35 comprises two permanent magnets 36 which are realized as a rectangular cuboid, respectively. Thus, the six faces of the respective permanent magnet 36 are rectangles. The respective permanent magnet 36 may be realized using a ferrite or a rare earth magnetic material. Moreover, the permanent magnet system 35 comprises two inner pole plates 37 and an outer pole plate 38. The inner and the outer pole plates 37, 38 have a L-shape form surrounding the first and the second arc extinguishing chamber 21, 22 as well as the first fixed and movable contacts 12, 14 and the contact bridge 16 in part.

The permanent magnets 36 are arranged between the inner pole plates 37 and the outer pole plate 38. Thus, the inner pole plates 37 may be south pole plates and the outer pole plate 38 may be realized as a north pole plate, or vice versa. The outer pole plate 38 has the form of a rectangle before the outer pole plate 38 is bended in the L-shape. Correspondingly, the inner pole plates 37 have the form of a rectangular sheet before it is bended to realize the L-shape. The inner and the outer pole plates 37, 38 may have openings.

For example, the inner pole plates 37 are separated to allow a placement and a movement of the contact bridge 16. In particular, the second fixed and movable contacts 13, 15 and the corresponding portion of the contact bridge 16 are arranged outside with respect to the L-shaped pole plates 37, 38.

The contact unit 10 as well as the switching device are configured to be set in a switched-on state or a switched-off state. The switched-off state is shown in all figures. In the switched-off state, the first fixed contact 12 is not in contact with the first movable contact 14. Correspondingly, the second fixed contact 13 is not in contact with the second movable contact 15. Thus, a flow of a load current from the first terminal contact 17 to the second terminal contact 18 via the contact bridge 16 is inhibited.

Figure 3:
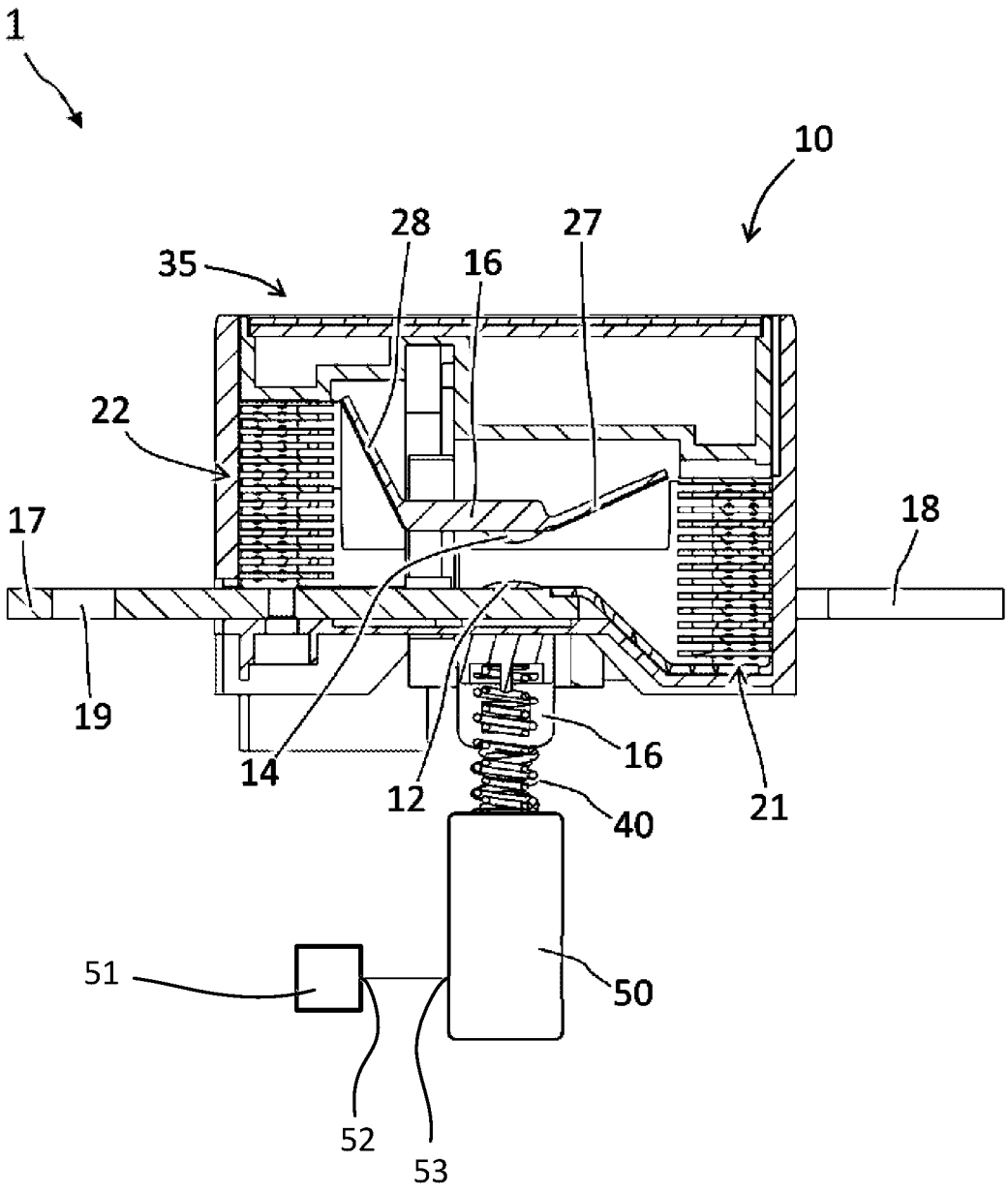
FIG. 3 shows an example of a switching device in a sectional view.
Figure 4:
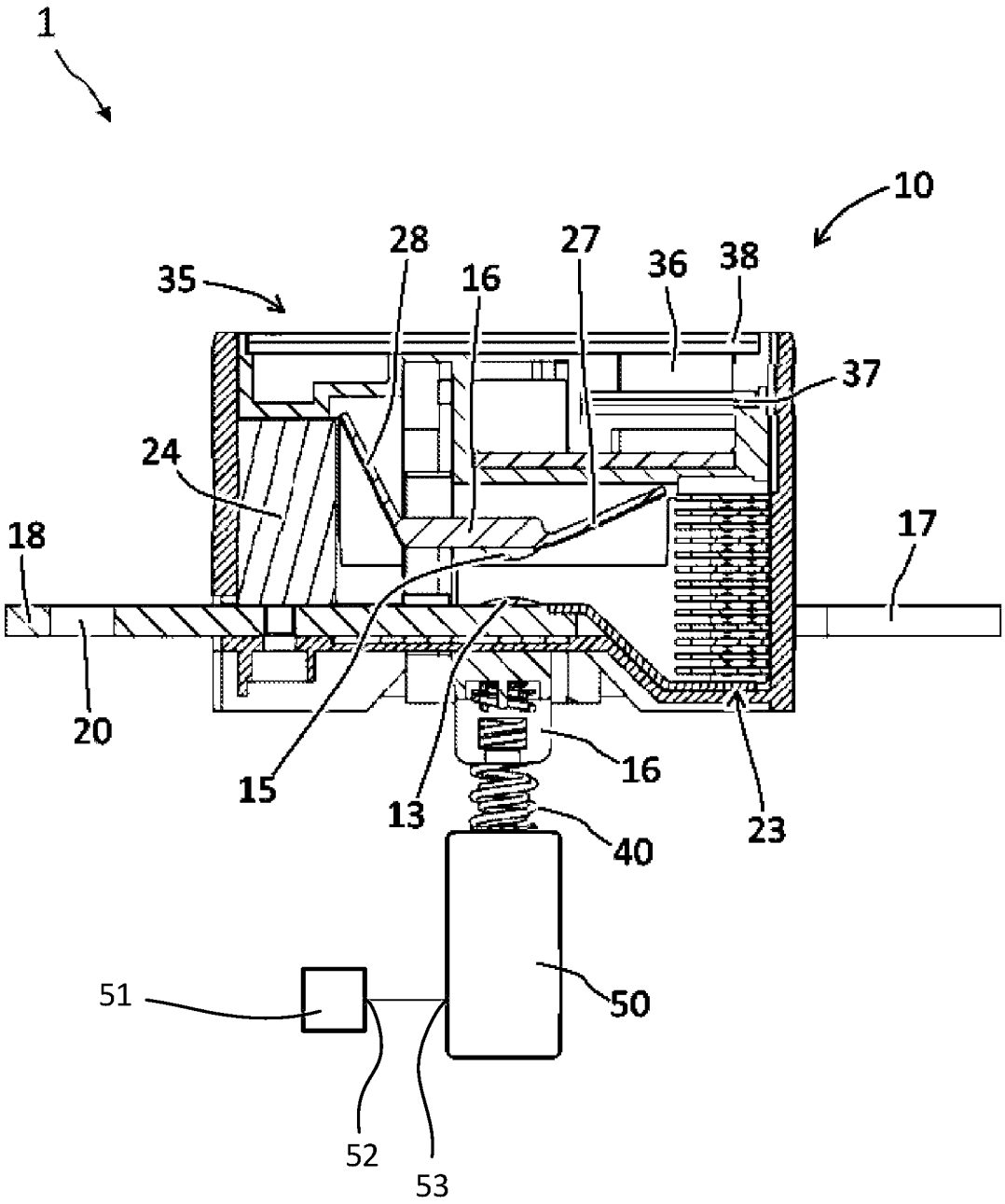
FIG. 4 shows the switching device of FIG. 3 in a further sectional view.

The contact unit 10 and the switching device are set from the switched-off state into the switched-on state by a movement of the contact bridge 16 in a direction perpendicular to the contact bridge 16. An electromagnetic drive unit 50, as shown in FIGS. 3 and 4, moves the contact bridge 16 towards the first and the second terminal contact 17, 18. In the switched-on state, the first fixed contact 12 is in contact to the first movable contact 14 and the second fixed contact 13 is in contact to the second movable contact 15. Thus, a load current can flow from the first terminal contact 17 via the first fixed contact 12, the first movable contact 14, the contact bridge 16, the second movable contact 15 and the second fixed contact 13 to the second terminal contact 18.

The switching device is set from the switched-on state into the switched-off state by a movement of the contact bridge 16 that separates the contact bridge 16 from the first and the second terminal contacts 17, 18. In case of a load current flowing before switching, a first arc may be generated between the first fixed contact 12 and the first movable contact 14 and a second arc may be generated between the second movable contact 15 and the second fixed contact 13. The first arc is driven in one of the first and second arc extinguishing chamber 21, 22 depending on the direction of the load current. For high load currents, for example >50 A, the second arc is driven in the third arc extinguishing chamber 23 independent of the direction of the load current. The second arc may not be driven in the third arc extinguishing chamber 23 for lower load currents, for example smaller than 50 A, as the driving force by the magnetic field of the current, reinforced by the magnetic reinforcing element 34 (also called "slot motor") may be too weak.

The movement of the first arc into one of the arc extinguishing chambers 21, 22 is caused by a magnetic field at the place of the first arc. The magnetic field is generated by the permanent magnet system 35 and by different sections of the path of the load current, for example the flow of the load current in an outer part of the contact bridge 16 that is connected to the first movable contact 14 and by the load current flowing through the first terminal contact 17. The second arc is moved in a corresponding manner but without the influence of the magnetic field of the permanent magnet system 35, that is only by the magnetic field of the load current.

A magnetic reinforcing element 34 enclosing the third arc extinguishing chamber 23, also called a "slot motor", may increase the magnetic field at the position of the second arc and may assist to guide the second arc to the third arc extinguishing chamber 23 in case of an overcurrent, for example a short circuit current. The reinforcing element 34 may have a U-shape cross-section as indicated in FIG. 2 surrounding the third arc extinguishing chamber 23 and a portion of the contact bridge 16 on three sides. The reinforcing element 34 or slot motor may comprise magnetic conductive material to enable beneficial guiding of short circuit arc.

The arcs that are generated when opening the contacts 12 to 15 are quickly moved away and are extinguished to safely control a high overcurrent. In the case of an overcurrent, the originated second arc between the second fixed and movable contacts 13, 15 is moved away by the form of the contact bridge 16 that realizes a so-called magnetic field loop or magnetic blowout field loop. A field loop increases the magnetic field generated by the current itself. Thus, in the case of an overcurrent, during the procedure of opening the contacts 12 to 15 dynamic Lorentz forces move the arcs away from the contacts 12 to 15 in the direction of the second or third arc extinguishing chamber 22 to 23.

With respect to the first arc generated between the first and the second arc extinguishing chamber 21, 22 the permanent magnet system 35 is acting on the first arc and drives it into the first or the second arc extinguishing chamber depending on the direction of the load current. The permanent magnet system 35 is realized as a permanent magnetic field arrangement and is used for driving a first arc with a load current being the nominal current or less.

FIGS. 3 and 4 show a respective sectional view of the switching device comprising the contact unit 10 and the coupled electromagnetic drive unit 50. Furthermore, a spring 40 is illustrated to bias the contact bridge 16 configured to securely and reliably set a switched-off state of the contact unit 10 and the switching device. A noise reduction or damping element 24 is arranged at the second terminal contact instead of a fourth arc extinguishing chamber, that is at an opposite side of the contact bridge 16 with respect to the third arc extinguishing chamber 23. A runner 28 may be directed to the volume decreasing element 24 is shown to be formed at the contact bridge 16 for symmetric reasons and reliable movement control. The switching device comprises a control circuit 51 having a signal output 52 coupled to a signal input 53 of the electromagnetic drive unit 50, wherein the control circuit 51 is configured to set the switching device in the switched-on state or in the switched-off state depending on a control signal provided to the signal input 53 of the electromagnetic drive unit 50.

The described switching device realizes a protective DC switching arrangement comprising only three arc extinguishing chambers 21 to 23, each with a dedicated functionality. Thus, the described configuration of the switching device enables saving expenses with respect to further extinguishing chamber, inter alia. Moreover, by the use of the illustrated arrangement of only three arc extinguishing chambers 21 to 23 a structure of the contact unit 10 and the switching device can be simplified. This may further be achieved by a simplified design of the permanent magnet system 35, thus further contributing to low cost manufacturing.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE NUMERALS

10 contact unit
12 first fixed contact
13 second fixed contact
14 first movable contact
15 second movable contact
16 contact bridge
17 first terminal contact
18 second terminal contact
19 terminal connection hole
20 terminal connection hole
21 first arc extinguishing chamber
22 second arc extinguishing chamber
23 third arc extinguishing chamber
24 noise reduction element
25 arc runner
26 arc runner
27 arc runner
28 runner
30 splitter plate
31 holder
34 magnetic reinforcing element
35 permanent magnet system
36 permanent magnet
37 inner pole plate
38 outer pole plate
40 spring
50 electromagnetic drive unit
51 control circuit
52 control circuit signal output
53 electromagnetic drive unit signal input

The invention claimed is:

1. A contact unit for a switching device, comprising:
a first fixed contact;
a second fixed contact;
a contact bridge;
a first movable contact and a second movable contact that are arranged at the contact bridge;
a first arc extinguishing chamber, a second arc extinguishing chamber, and a third arc extinguishing chamber; and
an arc guiding system,
wherein the first fixed contact is in contact with the first movable contact and the second fixed contact is in contact with the second movable contact in a switched-on state of the contact unit,
wherein the first fixed contact is free of contact with the first movable contact and the second fixed contact is free of contact with the second movable contact in a switched-off state of the contact unit,
wherein the first and the second arc extinguishing chamber and the arc guiding system are configured in coordination with each other to extinguish a first arc originating between the first fixed contact and the first movable contact depending on a current direction of a current flowing through the first fixed contact and the first movable contact,
wherein the third arc extinguishing chamber is configured for extinguishing a second arc originating between the second fixed contact and the second movable contact independent of a current direction of a current flowing through the second fixed contact and the second movable contact,
wherein the arc guiding system comprises a permanent magnet system which is configured to enclose only the first arc extinguishing chamber and the second arc extinguishing chamber,
wherein the first fixed contact and the first movable contact are within an area covered by a magnetic field of the permanent magnet system in the switched-on state and in the switched-off state of the contact unit, and
wherein the second fixed contact and the second movable contact are out of the area covered by the magnetic field of the permanent magnet system in the switched-on state and in the switched-off state of the contact unit.

2. The contact unit of claim 1, wherein the permanent magnet system comprises:
an inner pole plate and an outer pole plate each enclosing the first arc extinguishing chamber and the second arc extinguishing chamber; and
a permanent magnet that is arranged between the inner pole plate and the outer pole plate to provide an arc guiding magnetic field.

3. The contact unit of claim 2, wherein the first fixed contact and the first movable contact are between the inner pole plate and the outer pole plate in the switched-on state and in the switched-off state of the contact unit, and
wherein the second fixed contact and the second movable contact are outside of an inner space of the inner pole plate and the outer pole plate in the switched-on state and in the switched-off state of the contact unit.

4. The contact unit of claim 2, wherein the inner pole plate is at least partially L-shaped and the outer pole plate is at least partially L-shaped.

5. The contact unit of claim 1, further comprising:
a magnetic reinforcing element assigned to the third arc extinguishing chamber and configured to increase a magnetic field self-generated by a current between the second fixed contact and the second movable contact.

6. The contact unit of claim 5, wherein the magnetic reinforcing element comprises a U-shaped slot motor enclosing the third arc extinguishing chamber.

7. The contact unit of claim 1, further comprising:
a pair of arc runners arranged at the contact bridge near the first movable contact; and
a further arc runner arranged at the contact bridge near the second movable contact.

8. The contact unit of claim 1, further comprising:
a first terminal contact on which the first fixed contact is mounted; and
a second terminal contact on which the second fixed contact is mounted,
wherein a main direction of the first terminal contact is parallel to a main direction of the second terminal contact, and
wherein a straight line drawn between the first movable contact and the second movable contact is across the main direction of the first terminal contact.

9. The contact unit of claim 1, wherein the first arc extinguishing chamber, the second arc extinguishing chamber, and the arc guiding system are configured to extinguish the first arc originating between the first fixed contact and the first movable contact resulting from a load current, and
wherein the third arc extinguishing chamber is configured to extinguish the second arc originating between the second fixed contact and the second movable contact resulting from an overcurrent.

10. A switching device, comprising:

the contact unit of claim 1; and an electromagnetic drive unit coupled to the contact bridge of the contact unit configured to set the contact unit and thereby the switching device in the switched-on state or in the switched-off state due to excitation of at least one magnetic coil of the electromagnetic drive unit.

11. The switching device of claim 10, comprising:

a control circuit having a signal output coupled to a signal input of the electromagnetic drive unit, wherein the control circuit is configured to set the switching device in the switched-on state or in the switched-off state depending on a control signal provided to the signal input of the electromagnetic drive unit.

12. A contact unit for a switching device, comprising:

a first fixed contact;

a second fixed contact;

a contact bridge;

a first movable contact and a second movable contact that are arranged at the contact bridge;

a first arc extinguishing chamber, a second arc extinguishing chamber, and a third arc extinguishing chamber; and an arc guiding system, wherein the first fixed contact is in contact with the first movable contact and the second fixed contact is in contact with the second movable contact in a switched-on state of the contact unit, wherein the first fixed contact is free of contact with the first movable contact and the second fixed contact is free of contact with the second movable contact in a switched-off state of the contact unit, wherein the first and the second arc extinguishing chamber and the arc guiding system are configured in coordination with each other to extinguish a first arc originating between the first fixed contact and the first movable contact depending on a current direction of a current flowing through the first fixed contact and the first movable contact, wherein the third arc extinguishing chamber is configured for extinguishing a second arc originating between the second fixed contact and the second movable contact independent of a current direction of a current flowing through the second fixed contact and the second movable contact, wherein the arc guiding system comprises a permanent magnet system which is configured to enclose only the first arc extinguishing chamber and the second arc extinguishing chamber, and wherein the permanent magnet system comprises:

an inner pole plate and an outer pole plate each enclosing the first arc extinguishing chamber and the second arc extinguishing chamber; and a permanent magnet that is arranged between the inner pole plate and the outer pole plate to provide an arc guiding magnetic field.

13. The contact unit of claim 12, wherein the first fixed contact and the first movable contact are between the inner pole plate and the outer pole plate in the switched-on state and in the switched-off state of the contact unit, and wherein the second fixed contact and the second movable contact are outside of an inner space of the inner pole plate and the outer pole plate in the switched-on state and in the switched-off state of the contact unit.

14. The contact unit of claim 12, wherein the inner pole plate is at least partially L-shaped and the outer pole plate is at least partially L-shaped.

15. The contact unit of claim 12, further comprising:

a magnetic reinforcing element assigned to the third arc extinguishing chamber and configured to increase a magnetic field self-generated by a current between the second fixed contact and the second movable contact.

16. The contact unit of claim 15, wherein the magnetic reinforcing element comprises a U-shaped slot motor enclosing the third arc extinguishing chamber.

17. The contact unit of claim 12, further comprising:

a pair of arc runners arranged at the contact bridge near the first movable contact; and a further arc runner arranged at the contact bridge near the second movable contact.

18. The contact unit of claim 12, further comprising:

a first terminal contact on which the first fixed contact is mounted; and a second terminal contact on which the second fixed contact is mounted, wherein a main direction of the first terminal contact is parallel to a main direction of the second terminal contact, and wherein a straight line drawn between the first movable contact and the second movable contact is across the main direction of the first terminal contact.

19. The contact unit of claim 12, wherein the first arc extinguishing chamber, the second arc extinguishing chamber, and the arc guiding system are configured to extinguish the first arc originating between the first fixed contact and the first movable contact resulting from a load current, and wherein the third arc extinguishing chamber is configured to extinguish the second arc originating between the second fixed contact and the second movable contact resulting from an overcurrent.

20. A switching device, comprising:

the contact unit of claim 12; and an electromagnetic drive unit coupled to the contact bridge of the contact unit configured to set the contact unit and thereby the switching device in the switched-on state or in the switched-off state due to excitation of at least one magnetic coil of the electromagnetic drive unit.

* * * * *